United States Patent [19]

Kain

[11] 3,940,026

[45] Feb. 24, 1976

[54] CONTAINER FOR PRESSURE DISPENSING OF FLUID

[75] Inventor: Calvin L. Kain, Bartlesville, Okla.

[73] Assignee: KRDC, Bartlesville, Okla.

[22] Filed: July 13, 1973

[21] Appl. No.: 378,886

Related U.S. Application Data

[63] Continuation-in-part of Ser. No. 344,931, March 26, 1973, abandoned.

[52] U.S. Cl. ..... 222/212; 222/215

[51] Int. Cl.[2] ..... B67D 5/06

[58] Field of Search ..... 222/94, 130, 183, 211, 222/212, 92, 105, 129, 131, 206, 386.5, 215; 46/87, 90; 285/241, 242, 252, 259

[56] References Cited

UNITED STATES PATENTS

| | | | |
|---|---|---|---|
| 589,216 | 8/1897 | McKee | 285/259 X |
| 1,951,193 | 3/1934 | Heighway | 46/87 |
| 2,671,578 | 3/1954 | McBean | 222/211 X |
| 2,816,690 | 12/1957 | Lari | 222/92 |
| 3,361,303 | 1/1968 | Jacuzzi | 222/212 X |
| 3,625,400 | 12/1971 | Friedrich | 222/94 |
| 3,738,538 | 6/1973 | Roper et al. | 222/212 X |
| 3,753,516 | 8/1973 | Crider | 222/105 X |

*Primary Examiner*—Robert B. Reeves
*Assistant Examiner*—Joseph J. Rolla
*Attorney, Agent, or Firm*—Head, Johnson & Chafin

[57] ABSTRACT

This invention provides a new, simple, inexpensive and expedient means of attaching an expandible elastomeric pressure unit within an existing vessel using a readily available valve for dispensing fluid products contained therein. The present invention by using elastomeric pressure units for the dispensing of fluid products under pressure no longer requires the use of propellent gas therewith since the dispensing energy is contained in the elastomeric material of the unit itself, the dispensing p.s.i. being controllable by varying the thickness of the walls of the said pressure unit and the composition and make-up thereof.

The present invention also teaches various bonding techniques for efficiently attaching the pressure unit to the valve member in most cases where the container is filled through the valve itself and also for attaching the pressure unit to the vessel means in those cases wherein the container is filled around the valve but before the said valve is sealed into place.

11 Claims, 11 Drawing Figures

CONTAINER FOR PRESSURE DISPENSING OF FLUID

CROSS REFERENCE

This application is a Continuation-in-Part of copending application Ser. No. 344,931, filed Mar. 26, 1973, and entitled: "A Container For Pressure Dispensing Of Fluid" which has been abandoned.

BACKGROUND OF THE INVENTION

1. Field of the Invention

This invention relates to product dispensing containers and more particularly, but not by way of limitation, to a container for pressure dispensing of fluids by means of an elastomeric pressure unit disposed within a vessel, said pressure unit being expanded to accept the fluid product therein, the pressure dispensing of the product being provided by the contraction of the pressure unit while utilizing existing valve means.

2. Description of the Prior Art

Pressurized containers have become exceedingly popular in recent years. Since inception, the popularity of this mode of packaging has resulted in the present day availability of numerous products in pressurized dispersed form. There are, however, certain difficulties with existing pressure dispensing systems. The propellent gas in aerosol dispensers is relatively expensive and often must be used in equal proportions with the fluid to be dispensed. This requires the use of a large container for carrying a small amount which is expensive in container materials and inefficient in space utilization.

In addition, effective gas propellents are sometimes not compatible with certain products, especially foods. Further, aerosol containers are somewhat hazardous in that when subject to heat or puncture they explode with severity. Even depleted aerosol containers can be dangerous when subjected to high heat.

Others have suggested the use of bladders of elastic material positioned interiorly of containers as a means of dispensing liquid products. A problem exists, however, in that the known means of utilization of elastomeric bladders has required the manufacture of special types of valve support apparatus for sealably receiving the upper end of the bladder.

SUMMARY OF THE INVENTION

The present invention comprises a novel container for pressure dispensing of fluids which is particularly designed and constructed for overcoming the above disadvantage. This invention provides a new, simple, inexpensive and expedient means of attaching an expandible elastomeric pressure unit within an existing vessel using readily available valve means for dispensing fluid products contained therein. The present invention by using elastomeric pressure units for the dispensing of fluid products under pressure no longer requires the use of propellent gas therewith since the dispensing energy is contained in the elastomeric material of the unit itself, the dispensing p.s.i. being controllable by varying the thickness of the walls of the said pressure unit and the composition and make-up thereof.

The present invention also teaches various bonding techniques for efficiently attaching the pressure unit to the valve means in most cases where the container is filled through the valve itself and also means for attaching the pressure unit to the vessel means in those cases wherein the container is filled around the valve but before the said valve is sealed into place.

Since the present invention obviates the use of propellent gases, this space heretofore taken in existing vessels by the propellent gas may be replaced by product fluid whereby the producers may add extra product within an existing size can or may reduce the size of the can itself. Further, since propellent gas is not utilized in the present invention, the safety thereof is greatly enhanced and the walls of the outer vessel or container may be constructed of cardboard or other inexpensive materials.

It is further pointed out that by utilizing a pressure unit with elastic material thicknesses varying throughout, the said pressure unit may be designed to take the form of substantially any shaped container while still being able to control the dispensing p.s.i. capabilities thereof.

DETAILED DESCRIPTION

Figure 1:
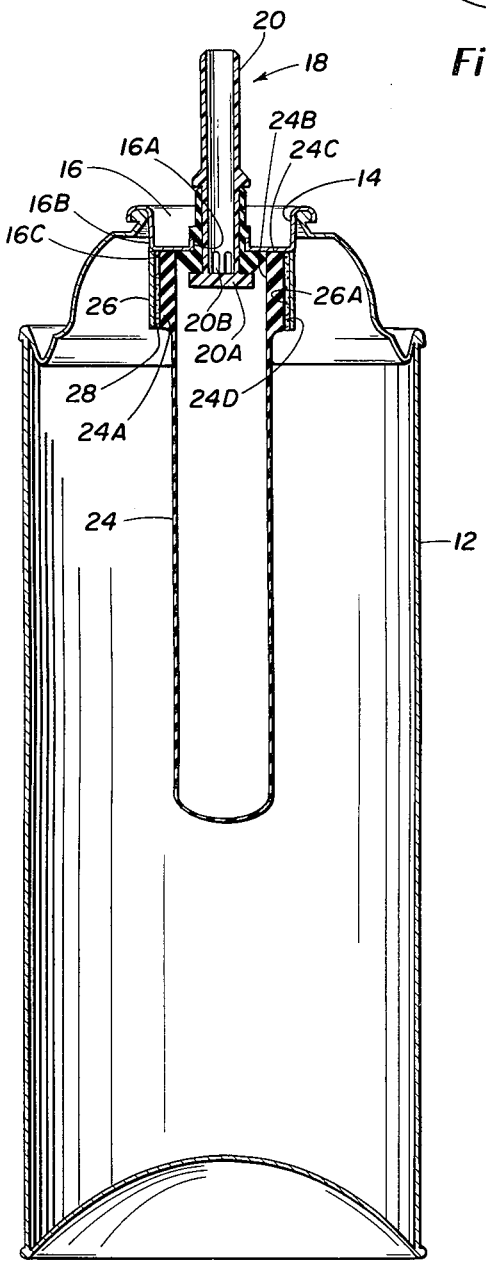
FIG. 1 is a cross sectional view of a container for pressure dispensing of fluid showing the container ready to be filled and showing the means of attachment of an elastomeric pressure unit to the valve support structure.

Referring now to the drawings and first to FIG. 1, the container for pressure dispensing of fluids is generally indicated by the numeral 10. The container includes an upright vessel 12 which is preferably formed of metal, but may also be formed of plastic material, cardboard or the like. The vessel 12 is depicted as being cylindrical in shape but may be of substantially any shape, an end plate 13 is secured to the upper end of the vessel 12 and has a centrally disposed opening 14 therein. Sealably received within the opening 14 is a valve support 16. The valve support 16 has an axial opening 16A which receives a valve generally indicated by the numeral 18. The specific valve structure 18 does not form a part of this invention, as several valve devices are on the market and in present use at this time. In the arrangement of FIG. 1, by way of example only, the valve 18 includes a rigid tubular member 20, of material such as plastic, having an enlarged diameter horizontal portion 20A at the lower end thereof. Openings 20B are provided in the tubular portion adjacent the enlarged diameter portion 20A. the tubular portion is received in a resilient retainer 22. Normally the enlarged diameter portion 20A seals against the lower end of the resilient retainer 22 to close the vessel so that liquids or gases retained interiorly will not escape to the exterior. When the tubular element 20 is displaced sideways by finger pressure, the element is tilted in the resilient member 22, exposing one or more of the openings 20B, allowing fluid to escape. When sideways pressure on tubular element 20 is relieved it returns to the axial or upright position and the openings 20B are closed. As previously indicated the specific valve structure is not a part of the invention and has been described herein merely as an example of one valve which will function in the invention.

The valve support 16 includes a cylindrical wall 16B which extends downwardly within the vessel 12, and a lower horizontal surface 16C. The valve support described is typical of these in present commercial usage and while the structures may vary slightly from one manufacturer to another nevertheless the valve supports in most common usage have the portions described.

The container described to this point is not unlike that of other known containers in present use today wherein the propellent used to cause the contents thereof to be discharged is in the form of a compressed gas. The interior of the vessel 12 is filled with the material to be discharged and when the valve 20 is opened the propellent gas forces the liquid therein to pass outwardly. Some containers include a downwardly extending tube (not shown) so that the liquid in the bottom of the container is first discharged.

This invention includes the provision of a pressure unit of elastomeric material 24, and more particularly the means of affixing the pressure unit 24 to the valve support 16. The pressure unit 24 has an upper tubular portion 24A, the internal diameter thereof being indicated by the numeral 24B. The pressure unit tubular portion 24A terminates at the upper opened end thereof with an annular top surface 24C.

Positioned around the pressure unit tubular portion 24A is a tubular band of rigid material 26.

The pressure unit 24 may be affixed to the valve support 16 in two basic ways. In the arrangement shown in FIG. 1 the tubular band of rigid material 26 is of metal and the upper end surface of the band 26 is welded to the horizontal surface 16C of the valve support. The exterior surface 24D of the tubular portion 24A of the tubular band is bonded to the inside surface 26A of the tubular band 26, the bonding material being indicated by the numeral 28.

Figure 2:
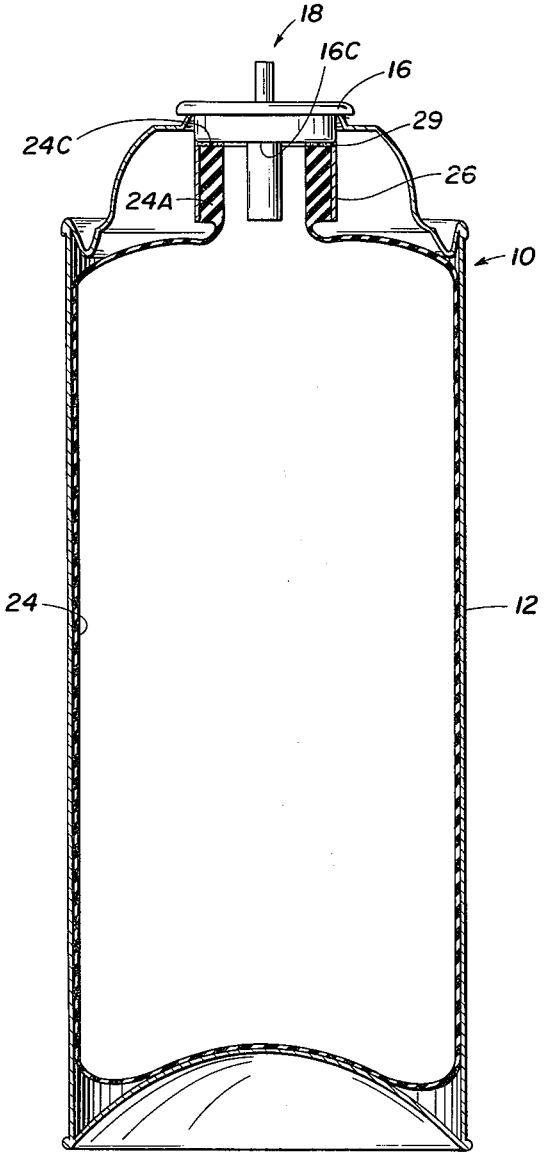
FIG. 2 is a cross sectional view as shown in FIG. 1 but showing the pressure unit in the fully expanded condition and showing a different type of valve structure.

In FIG. 2 an alternate means of affixing the pressure unit tubular portion 24A is illustrated. In this arrangement bonding material 29 is applied between the annular top surface 24C of the pressure unit and the lower horizontal surface 16C of the valve support.

In either arrangement of the pressure unit is supported without altering the valve structure. In addition, the support means, including the tubular band 26, retains the pressure unit 24 in position while prohibiting the tubular portion 24A from expanding when the pressure unit is filled.

Figure 3:
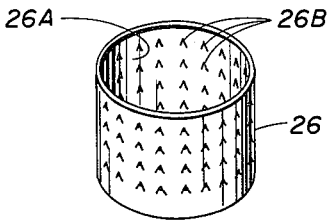
FIG. 3 is a prospective view of the tubular band element of the invention showing an alternate arrangement for increasing the effectiveness of the band to retain the pressure unit.

FIG. 3 shows an alternate arrangement wherein the tubular band of rigid material 26 includes a plurality of protrusions 26B extending inwardly from the interior surface. One means as illustrated providing the inward protrusion 26B is, as shown, a plurality of inverted V-shaped slits cut in the wall of the tubular band 26 with the apexes of the slits depressed inwardly to form the protrusion 26B. In this way the extending protrusions 26B project slightly into the. outer cylindrical surface of the pressure unit tubular portion to assist in retaining the pressure unit in position.

The embodiment hereinbefore described in relation to that depicted in FIGS. 1 and 2 in an embodiment which is particularly adaptable for use wherein the filling technique used is that of filling the container or the pressure unit 24 thereof through the valve structure 18. Hence, in that embodiment the tubular portion 24A of the pressure unit 24 may be secured to or bonded to the lower horizontal surface of the valve 16 in a manner as hereinbefore set forth and the said valve 16 secured to the top end plate 13 of the vessel 12 in any well known manner such as cramping the upper end portion of the valve support cylindrical wall 16B over a preformed annular shape flange member 13A which is provided around the opening 14 in the top end plate 13. Filling the container with the desired fluid may then be accomplished by filling through the valve member 18 thereof.

However, there is a second filling technique that is widely used in the field which would render the above embodiment inappropriate therewith. This second filling technique is accomplished by filling the vessel 12 with the desired fluid around the valve 18 and its associated valve support 16 before the said valve support member 16 is secured in place on the top end plate 13 of the vessel 12. This technique is known as filling around the valve wherein before the said valve support member 16 with its associated valve 18 is secured into place the can is filled therearound. After the can has been charged to capacity the valve support means is dropped into place and the top edge or rim thereof is cramped over the flange member 13A for providing a seal therearound.

Figure 4:
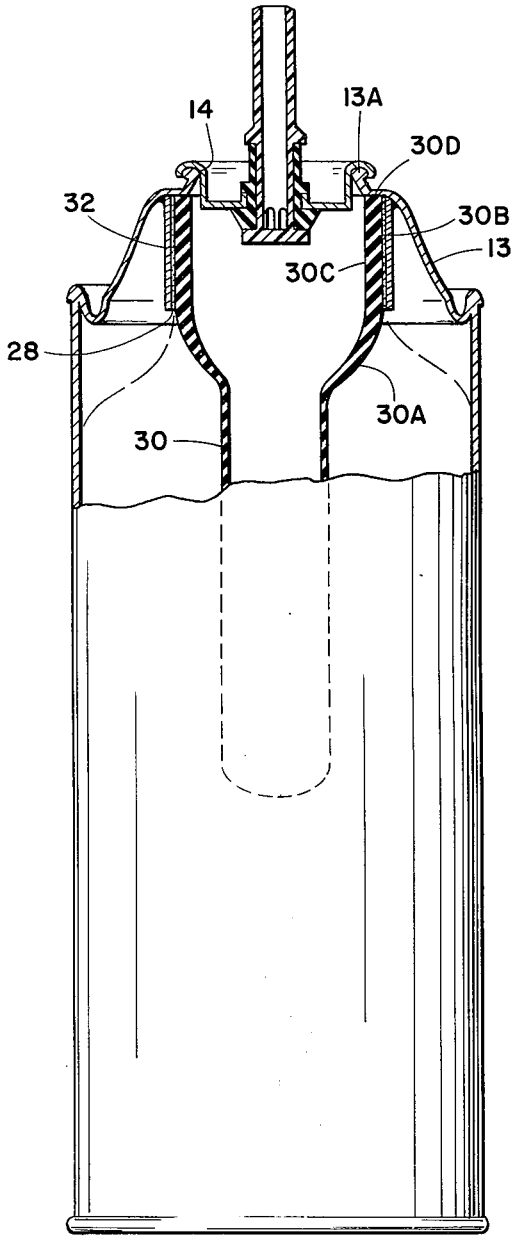
FIG. 4 is a partial sectional elevational view of the container of FIG. 1 wherein the pressure unit is secured to the top of the vessel rather than to the valve support surface.

Referring now to FIG. 4 reference character 30 indicates an elastomeric pressure unit similar to the pressure unit 24 hereinbefore described. The pressure unit member 30 comprises a lower cylindrical shaped body member which is depicted in its relaxed state in FIG. 4 a similar pressure unit and is depicted in its expanded or filled shape in FIG. 5. The upper end of the pressure unit 30 is provided with an upper tubular portion 30A having an outside cylindrical wall 30B, an inside cylindrical wall 30C and an annular top surface 30D therearound. The interior diameter 30C of the pressure unit 30 is expanded to be larger than the opening 14 provided in the top end plate 13.

Therefore, upon installation of the pressure unit 30 within the vessel 12 the upper end or annular top surface 30B of the tubular member 30A is bonded directly to the inside surface of the top end plate 13 adjacent to the opening 14 therein. A tubular band 32 of rigid material similar to the band 26 for the first embodiment hereof is secured directly to the top end plate 13 within the vessel 12, the upper annular end thereof being secured in place by any well known metal to metal bonding such as by welding or the like. The inside diameter of the tubular band 32 is of a size substantially equal to the outside diameter of the tubular portion 30A of the pressure unit 30, for receiving the said tubular portion 30A therein. The outside surface 30B of the tubular portion 30A is then bonded to the inside surface of the tubular band 32 by any well known bonding material 28 as used in relation to the pressure unit 24 hereinbefore described. This tubular band 32 will provide an additional bonding surface for securing the upper portion 30A of the pressure unit 30 thereto while tending to prevent expansion of the upper portion 30A of the pressure unit 30 upon filling the pressure unit therein with the desired fluid to be dispensed thereby.

Figure 5:
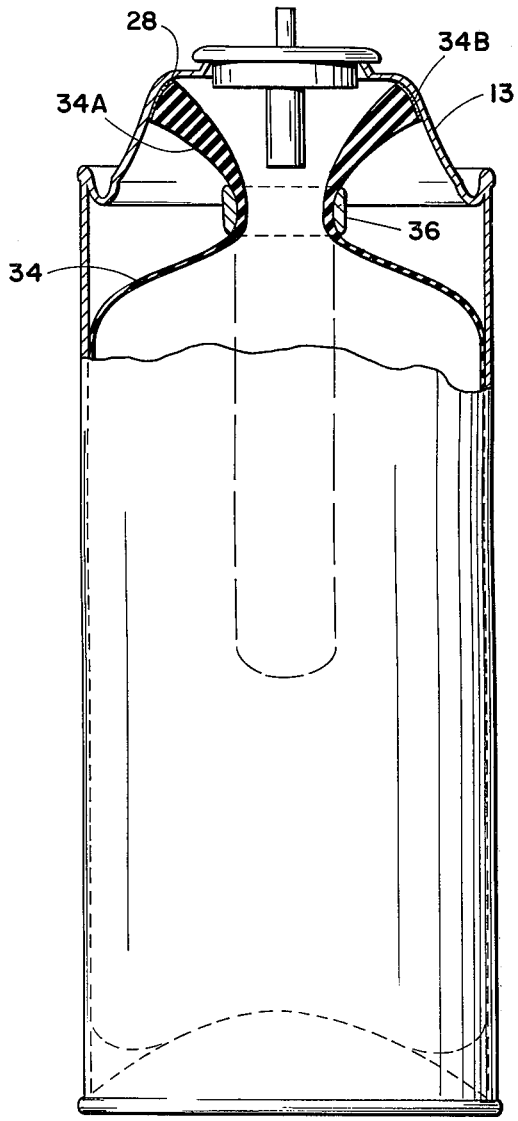
FIG. 5 is a partial sectional elevational view of the container of FIG. 2 wherein the pressure unit is secured to the top inside portion of the vessel rather than to the valve.

Referring now to FIG. 5 reference character 34 represents an alternate type pressure unit that may be utilized for around-the-valve filling or containers. The upper tubular portion 34A of the pressure unit 34 is constructed in a substantially conical shape or more exactly a truncated conical shape, the annular top surface 34B thereof being flared outwardly in order to directly contact the inside surface of the top end plate 13. The outer end of the upper tubular portion 34A is thickened to provide a wider annular top surface 34B which provides a larger area of bonding contact between the said annular top portion surface 34B and the inside wall of the top end plate.

A cylindrical band 36 is secured around the pressure unit 34 adjacent to the upper tubular portion 34A thereof, the said band 36 having an inside diameter substantially equal to the outside diameter of the pressure unit 34 when it is in its relaxed position as depicted by the dashed lines in FIG. 5. The band 36 serves to prevent the upper tubular portion 34 from expanding outwardly upon filling of the pressure unit 34 with the desired fluid to be dispensed thereby. Installation of the pressure unit 34 within the vessel 12 is accomplished by simply bonding the annular top surface 34B of the upper tubular portion of the pressure unit 34 directly to the inside surface of the top end plate 13 by means of a suitable bonding material 28. By bonding the annular top surfaces of the pressure unit 30 and 34 to the inside surface of the top end plate 13 will facilitate the filling thereof by the around-the-valve techniques as hereinbefore set forth. It is further noted that the tubular band 32 of the embodiment of FIG. 4 may be provided with a plurality of protrusions which extend inwardly and upwardly therefrom and as set forth or described in FIG. 3 herein to facilitate the bonding of the upper tubular portion 30A thereto.

Figure 6:
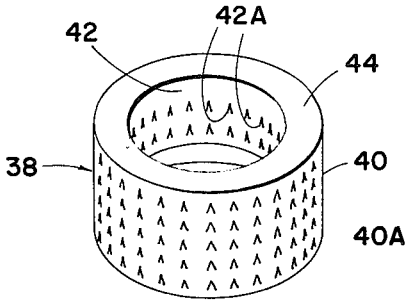
FIG. 6 is a perspective view of an attachment device to facilitate the attachment of the pressure unit to the vessel or to the valve means itself or the container as depicted in FIGS. 1 and 4.
Figure 7:
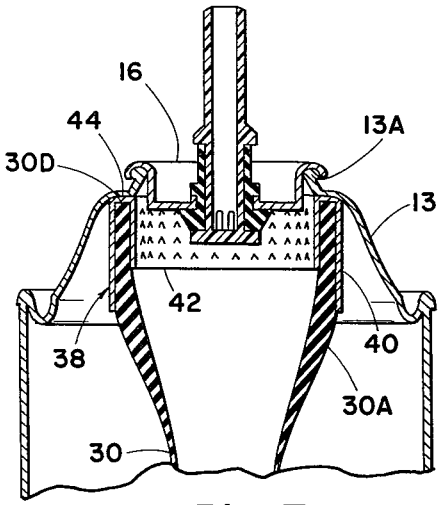
FIG. 7 is a sectional elevational view of the container of FIG. 4 and having the attachment means of FIG. 6 installed thereon.

Referring now to FIGS. 6 and 7 reference character 38 generally indicates an attachment device for utilization in place of the tubular band 32 on the pressure unit embodiment as depicted in FIG. 4. The attachment device 38 comprises an outer cylindrical band 40 having an inside diameter substantially equal to the outside diameter of the upper tubular portion 30A of the pressure unit 30 and a concentrically disposed inner cylindrical band 42 having an outside diameter substantially equal to the inside diameter of the upper tubular portion 30A of the pressure unit 30. An annular top ring 44 is secured around the upper edges of the cylindrical bands 40 and 42 for holding the said bands in their respective positions and for another purpose that will be hereinafter set forth. The outer band 40 is provided with a plurality of spaced inverted V-shaped cutouts which are pressed inwardly to form a plurality of inwardly and upwardly extending protrusions 40A which are similar to the protrusions 26B of the tubular band 26. Likewise the inner cylindrical band 32 is provided with a plurality of inverted V-shaped cutouts 42A which are pressed outwardly to form a plurality of spaced protrusions 42A.

In the application as depicted in FIG. 7 the upper tubular portion 30A of the pressure unit 30 may be inserted between the cylindrical bands 40 and 42 so that the upper annular surface 30D of the pressure unit 30 is positioned directly against the lower surface of the annular ring member 44. In addition to the retaining effect provided by the protrusions 40A and 42A with respect to the upper tubular portion 30A of the pressure unit 30, additional bonding may be accomplished by utilization of bonding material such as the bonding material 28 hereinbefore described. The attachment device 38 may then be secured to the inside surface of the top end plate 13 by any well known metal to metal bonding such as by welding or the like. It is therefore obvious that by utilization of the attachment device 38 an extremely strong bond may be accomplished between the upper tubular portion 30A of the pressure unit 30 with respect to the end plate 13.

Figure 8:
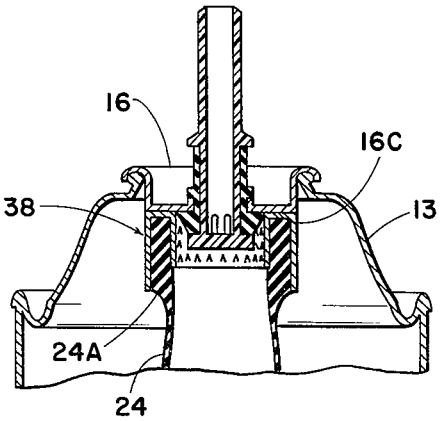
FIG. 8 is a sectional elevational view of the upper portion of the container of FIG. 1 having the attachment mechanism of FIG. 6 installed therein.
Figure 11:
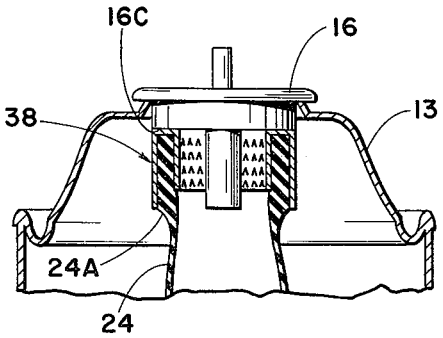
FIG. 11 is an elevational sectional view of the upper portion of the container of FIG. 2 wherein the attachment mechanism of FIG. 6 is installed thereon.

Referring now to FIGS. 8 and 11 a small sized version of the attachment device 38 may be utilized to securely bond the upper tubular portion 24A of the pressure unit 24 directly to the bottom annular surface 16C of the valve support member 16.

Figure 9:
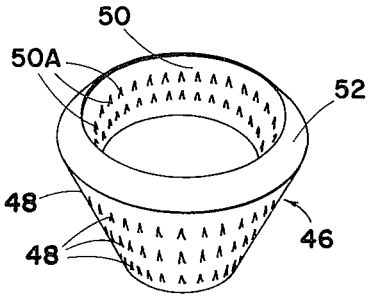
FIG. 9 is an attachment mechanism to facilitate the attachment of the pressure unit as shown in the container of FIG. 5 to the upper inside portion of the vessel.
Figure 10:
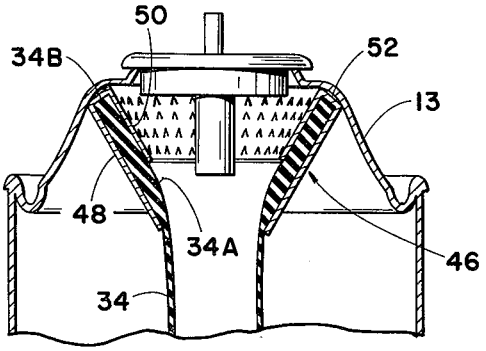
FIG. 10 is a sectional elevational view of the container of FIG. 5 and having the attachment device of FIG. 9 installed thereon.

Referring now to FIGS. 9 and 10 reference character 46 generally indicates a truncated conical shaped attachment device for use in securing the upper tubular portion 34A of the pressure unit 34 which has been described in relation to the drawing of FIG. 5. The attachment device 46 comprises an outer truncated conical shaped band 48 having a plurality of inwardly and upwardly directed protrusions 48A which are substantially identical to the protrusions 40A and 42A of the cylindrical bands 40 and 42 respectively. The inside surface of the conical shaped band 48 is sized to substantially conform to the outer surface of the conical shaped upper tubular member 34A of the pressure unit 34. The attachment device 46 also comprises an inner truncated conical shaped band 50 having a plurality of outwardly and upwardly extending protrusions 50A which are substantially identical to the protrusions 48A of the outer band 48. The outer surface of the conical shaped band 50 is sized to conform to the inner surface of the conical shaped upper tubular portion 34A of the pressure unit 34. An annular ring member 52 is secured between the upper circular edges of the outer and inner bands 48 and 50 for holding the said outer and inner bands in spaced concentric alignment and for a second purpose that will be hereinafter set forth.

In construction, the upper tubular portion 34A of the pressure unit 34 is inserted between the conical shaped bands 48 and 50 so that the upper annular surface 34B of the pressure unit 34 is disposed against the inside surface of the annular shaped ring 52. In addition to the pressure unit retention effect provided by the inwardly and upwardly extending protrusions 48A and 50A, bonding material is provided between the surfaces of the attachment means 46 and the conical shaped upper tubular portion 34A of the pressure unit 34. The annular shaped ring 52 is then welded directly to the inside surface of the upper end plate or top end plate 13 or secured thereto by any other well known metal to metal bond. It is further noted that when utilizing the attachment device 46 for attaching the pressure unit 34, it is no longer necessary to utilize the cylindrical band 36 for holding the upper tubular portion 34A in a conical shape since the same purpose is provided by the lower edge of the outer band 48 of the attachment device 46 which may be curved outwardly to prevent damage to the pressure unit 34.

From the foregoing it is apparent that the present invention provides a novel container for the pressure dispensing of fluids wherein an elastomeric pressure unit is disposed within the vessel and firmly secured in place therein, and whereby the said fluids may be dispensed under pressure due to the elasticity of said pressure unit material which eliminates the need for expensive and dangerous propellant heretofore used therein. It is also readily apparent that the novel device provides an attachment means for the bladder which is particularly adaptable for both through-the-valve filling and around-the-valve filling techniques commonly used in the trade.

Whereas the present invention has been described in particular relation to the drawings attached hereto, it is understood that other and further modifications apart from those shown or suggested herein, may be made within the spirit and scope of this invention.

What is claimed is:

1. A container for pressure dispensing fluid products comprising:

a vessel having an opening in one end thereof;

a cover closing said vessel opening, the cover having an opening therein and having, as a portion thereof, a valve support sealably closing the cover opening;

valve means carried by said valve support for providing a fluid passageway therethrough;

an expandable and contractable pressure unit of elastomeric material having a tubular portion terminating at an open end with an annular surface, said annular surface being bonded to said vessel end cover, and means carried by the pressure unit for stiffening the tubular portion at and adjacent to the open end thereof; and whereby fluid product contained by the pressure unit in an expanded position is expelled by return force exerted by the elastomeric material of the pressure unit.

2. A container for pressure dispensing fluid products in accordance with claim 1 wherein the means for stiffening the tubular portion of the pressure unit comprises thickened elastomeric material in the tubular portion, and wherein the valve support is provided with an annular surface and the tubular portion annular surface is bonded thereto by an adhesive.

3. A container for pressure dispensing fluid products in accordance with claim 1 wherein the means for stiffening the tubular portion of the pressure unit comprises thickened elastomeric material at the tubular portion and wherein the tubular portion annular surface is bonded to the interior surface of the vessel cover around the opening in said cover.

4. A container for pressure dispensing fluid products in accordance with claim 1 wherein the means for stiffening the tubular portion of the pressure unit comprises a pair of concentrically spaced tubular sleeves or rigid material, the tubular portion annular surface comprising a ring member of rigid material secured to one end of the tubular sleeves and wherein the tubular portion of said pressure pressure unit is bonded within the space between the sleeves and in contact with the ring member and bonded thereto, and wherein the valve support is provided with an annular surface, said ring member being bonded to the valve support annular surface.

5. A container for pressure dispensing fluid products in accordance with claim 4 wherein said annular ring member is of metal material and said valve support is of metal material and wherein said annular ring is bonded to said valve support by metal-to-metal bond.

6. A container for pressure dispensing fluid products in accordance with claim 1 wherein the means for stiffening the tubular portion of the pressure unit comprises thickened elastomeric material at and adjacent to the open end of the tubular portion and wherein said tubular portion is flared outwardly into a truncated conical shape, the annular surface thereof being bonded to the inside surface of the vessel cover.

7. A container for pressure dispensing fluid products in accordance with claim 1 wherein the means for stiffening the tubular portion comprises a pair of concentrically spaced truncated conical shaped sleeves or rigid material, the tubular portion of the pressure unit being flared to a truncated conical shape, the tubular portion annular surface comprising a ring member of rigid material secured to one end of the spaced sleeves and wherein the tubular portion of said pressure unit is bonded within the space between the sleeves and in contact with the ring member, said ring member being bonded to the inside surface of the vessel cover.

8. A container for pressure dispensing fluid products comprising:

a valve support having an annular surface on one side thereof;

valve means carried by said valve support for providing a fluid passageway therethrough;

an expandable and contractable pressure unit of elastomeric material having a tubular portion terminating at an open end with an annular surface, said tubular portion annular surface being bonded to said valve support annular surface, means carried by the pressure unit for stiffening the tubular portion at and adjacent to the open and thereof; and whereby fluid product contained by the pressure unit in an expanded position is expelled by the return force exerted by the elastomeric material of the pressure unit.

9. A container for pressure dispensing fluid products in accordance with claim 8 wherein the means for stiffening the tubular portion of the pressure unit comprises thickened elastomeric material at and adjacent to the open end of the tubular portion and wherein the tubular portion annular surface is bonded to the valve support annular surface with adhesive.

10. A container for pressure dispensing fluid products in accordance with claim 8 wherein the means for stiffening the tubular portion comprises a pair of concentrically spaced tubular sleeves of rigid material, the tubular portion annular surface comprising a ring member of rigid material secured to one end of the tubular sleeves and wherein the tubular portion of said pressure unit is bonded within the space between the sleeves and in contact with the ring member, said ring member being bonded to the valve support annular surface.

11. A container for pressure dispensing fluid products in accordance with claim 10 wherein the tubular sleeves and ring member are integrally formed of metal material and wherein the valve support is of metal material and the ring member portion is bonded to the valve support annular surface by a metal to metal bond.

* * * * *